US011117025B2

(12) United States Patent
Gulick

(10) Patent No.: US 11,117,025 B2
(45) Date of Patent: Sep. 14, 2021

(54) GOLF CLUB HEAD AND METHOD OF MANUFACTURING THE SAME

(71) Applicant: Grant William Gulick, Endwell, NY (US)

(72) Inventor: Grant William Gulick, Endwell, NY (US)

( * ) Notice: Subject to any disclaimer, the term of this patent is extended or adjusted under 35 U.S.C. 154(b) by 0 days.

(21) Appl. No.: 17/073,832

(22) Filed: Oct. 19, 2020

(65) Prior Publication Data

US 2021/0113895 A1 Apr. 22, 2021

Related U.S. Application Data

(60) Provisional application No. 62/916,648, filed on Oct. 17, 2019.

(51) Int. Cl.
*A63B 53/04* (2015.01)

(52) U.S. Cl.
CPC ..... *A63B 53/0433* (2020.08); *A63B 53/047* (2013.01); *A63B 2053/0479* (2013.01)

(58) Field of Classification Search
CPC ..... A63B 53/047; A63B 2053/0479; A63B 2053/0483
USPC ..... 473/350
See application file for complete search history.

(56) References Cited

U.S. PATENT DOCUMENTS 5,301,944 A * 4/1994 Koehler ..... A63B 53/04 473/328
5,377,983 A * 1/1995 Fenton ..... A63B 53/047 473/328
5,603,668 A * 2/1997 Antonious ..... A63B 53/047 473/328
5,800,281 A * 9/1998 Gilbert ..... A63B 53/047 473/287
5,971,866 A * 10/1999 Adams ..... A63B 60/00 473/328
6,045,453 A * 4/2000 Jenkins ..... A63B 53/047 473/255
7,393,286 B1 * 7/2008 Renegar ..... A63B 53/047 473/328
7,442,130 B2 * 10/2008 Ban ..... A63B 53/00 473/290

(Continued)

FOREIGN PATENT DOCUMENTS

GB 2253356 A * 9/1992 ..... A63B 53/0441
JP 07299164 A * 11/1995 ..... A63B 53/047

(Continued)

*Primary Examiner* — Alvin A Hunter

(74) *Attorney, Agent, or Firm* — Barclay Damon LLP

(57) ABSTRACT

A golf club head comprises a body including a top and a bottom and a hosel connected to the body. The body comprises a forward face defining a leading edge and an opposing rearward facing surface defining a trailing edge. At least one weight shifting element is positioned on the rearward facing surface. A sole extends between the leading edge and the trailing edge and defines a center portion, a first end surface and a second end surface. A static bounce angle is equal to an effective bounce angle when the center portion is square with the ground, and the effective bounce angle is greater than the static bounce angle when the center portion is not square with the ground and the second end surface is positioned away from the ground.

14 Claims, 19 Drawing Sheets

(56) References Cited

U.S. PATENT DOCUMENTS

| | | | | |
|---|---|---|---|---|
| 7,614,962 | B1 * | 11/2009 | Clausen | A63B 53/047 473/291 |
| 8,734,270 | B2 * | 5/2014 | Harrington | A63B 60/00 473/328 |
| 10,143,900 | B2 * | 12/2018 | Harrington | A63B 53/047 |
| 10,238,930 | B2 * | 3/2019 | Ripp | A63B 53/047 |
| 10,661,131 | B2 * | 5/2020 | Harrington | A63B 53/047 |
| 10,843,052 | B2 * | 11/2020 | Seagram | A63B 53/047 |
| 2015/0057096 | A1 * | 2/2015 | Nicolette | A63B 53/047 473/290 |

FOREIGN PATENT DOCUMENTS

| | | | | | |
|---|---|---|---|---|---|
| JP | 08155061 | A | * | 6/1996 | |
| JP | 08257179 | A | * | 10/1996 | A63B 53/04 |
| JP | 09038252 | A | * | 2/1997 | A63B 53/04 |
| JP | 09117538 | A | * | 5/1997 | |
| JP | 09253249 | A | * | 9/1997 | |
| JP | 09262320 | A | * | 10/1997 | |
| JP | 09299520 | A | * | 11/1997 | |
| JP | 2000135301 | A | * | 5/2000 | |
| JP | 2000229137 | A | * | 8/2000 | |
| JP | 2000354644 | A | * | 12/2000 | |
| JP | 2001252380 | A | * | 9/2001 | A63B 53/047 |
| JP | 2003220160 | A | * | 8/2003 | |
| JP | 2005073780 | A | * | 3/2005 | |
| JP | 2005168831 | A | * | 6/2005 | |
| JP | 2005287749 | A | * | 10/2005 | |
| JP | 2007215761 | A | * | 8/2007 | |
| JP | 2009201703 | A | * | 9/2009 | A63B 53/047 |

* cited by examiner

GOLF CLUB HEAD AND METHOD OF MANUFACTURING THE SAME

CROSS-REFERENCE TO RELATED APPLICATIONS

This application claims the benefit of and priority to U.S. Provisional Patent Application No. 62/916,648, filed on Oct. 17, 2019, the contents of which is incorporated herein by reference.

TECHNOLOGICAL FIELD

This invention relates to a golf club head configured to increase precision, club head speed, and ball control. This invention also relates to an associated method of manufacturing said golf club head.

BACKGROUND

Every year golf club manufacturers race to produce more forgiving golf clubs to help amateurs and professional golfers improve their performance and lower their scores on the golf course. The current approach to improving forgiveness is to remove material from the center of the club head face or center of the club head and/or increase the amount of material surrounding the club face. This so called "perimeter weighting" has been used for decades in an attempt to produce more forgiving golf clubs that give a player greater control including on a missed shot. One problem with perimeter weighting is its tendency to produce "hot spots" on the club head face, which can affect the launch of the golf ball from the club head face. These "hot spots" also lead to a golf shot with an overall decreased level of backspin relative to the golfer's regular golf shot. The result is a significant decrease in control and precision for the golfer.

Another method of increasing forgiveness in golf clubs is to increase the size of the club head sole from the club head face to the rearward face of the club. The increased size of the sole is meant to prevent a "chunked" golf shot. A "chunked" golf shot occurs when the player swings a golf club such that the club head strikes and digs into the ground prior to reaching the position of the golf ball. This is in contrast to the preferred golf swing where the player swings the golf club such that the club head strikes the ball before it strikes the ground. A "chunked" golf shot is considered a mishit and contacting the club head with the ground prior to contacting the golf ball acts to decrease club head speed and consequently decreases the distance that the golf ball travels. Increasing the size of the sole of the club head makes it more difficult for the club head to dig into the ground before striking the golf ball in the case of a missed golf shot. However, when the player's swing causes the club head to strike the ground before the golf ball, the increased size of the sole tends to cause the club head bounce off of the ground and strike the golf ball with the leading edge of the club head, rather than the club head face. This results in a mishit golf ball having a trajectory that is generally lower than usual and whose distance cannot be controlled. Accordingly, the methods currently used to produce more forgiving golf clubs have major disadvantages.

In addition, these methods do very little to improve the precision of the golf shot. For instance, precision around the green of a golf course requires a golfer to decrease the distance of the wedge approach golf shot while increasing the ball spin imparted on the golf ball. Such a combination is impossible to achieve with golf clubs currently on the market.

These are just some of the problems associated with current golf club heads being sold.

SUMMARY

An embodiment of a golf club head comprises a body extending from a first body end to a second body end and having a top and a bottom. The body comprises a forward face extending between the top and the bottom of the body. The forward face comprises a first forward facing surface portion defining plurality of grooves configured to contact a golf ball, a leading edge positioned proximate the bottom of the body, and a second forward facing surface portion adjacent the first forward facing surface portion. The body further comprises an opposing rearward facing surface extending between the top and the bottom of the body and defining a trailing edge proximate the bottom of the body. The rearward facing surface comprises at least one weight shifting element positioned proximate the second body end. A sole extends between the leading edge and the trailing edge and defines a center portion, a first end surface and a second end surface. A hosel is connected to the body at the first body end and extends in a direction away from the sole. A static bounce angle is equal to an effective bounce angle when the center portion of the sole is square with the ground, and the effective bounce angle is greater than the static bounce angle when the center portion is not square with the ground and the second end surface is positioned away from the ground.

In an embodiment of the golf club head, at least one of the first end surface and the second end surface of the sole are positioned at an angle relative to the center portion of the sole. In an embodiment of the golf club head, the angle is about 10°.

In an embodiment of the golf club head, the at least one weight shifting element comprises a depression and in an embodiment, the depression is configured to accept an insert comprising a material of lesser density than a material comprising the golf club head. In an embodiment of the golf club head, the first forward facing surface extends along a first forward facing surface plane and the second forward facing surface portion extends along a second forward facing surface plane that intersects the first forward facing surface plane. In another embodiment of the golf club head, at least the a first forward facing surface is comprised of a material having a coefficient of friction to urethane ratio greater than 1.

An embodiment of a method of manufacturing a golf club head configured to generate an increased rate of ball spin is disclosed. The method comprises providing a golf club head comprising a body extending from a first body end to a second body end and having a top and a bottom. The body comprises a forward facing surface extending between the top and the bottom of the body. The forward facing surface comprises a first forward facing surface portion defining plurality of grooves configured to contact a golf ball, a leading edge positioned proximate the bottom of the body, and a second forward facing surface portion adjacent the first forward facing surface portion. The body further comprises an opposing rearward facing surface extending between the top and the bottom of the body and defining a trailing edge proximate the bottom of the body. The rearward facing surface comprises at least one weight shifting element positioned proximate the second body end. A sole extends between the leading edge and the trailing edge and defines a center portion, a first end surface and a second end surface. A hosel is connected to the body at the first body end and extending in a direction away from the sole. The sole is formed such that (i) a static bounce angle is equal to an effective bounce angle when the center portion of the sole is square with the ground, and (ii) the effective bounce angle is greater than the static bounce angle when the center portion is not square with the ground and the second end surface is positioned away from the ground.

In an embodiment of the method, at least one of the first end surface and the second end surface of the sole are formed at an angle relative to the center portion of the sole an in an embodiment, the angle is about 10°.

In an embodiment of the method, the at least one weight shifting element comprises a depression and in an embodiment, the depression is configured to accept an insert comprising a material of lesser density than a material comprising the golf club head. In an embodiment of the method, the first forward facing surface extends along a first forward facing surface plane and the second forward facing surface portion extends along a second forward facing surface plane that intersects the first forward facing surface plane. In another embodiment of the method, at least the a first forward facing surface is comprised of a material having a coefficient of friction to urethane ratio greater than 1.

Additional features and advantages of the present disclosure are described in, and will be apparent from, the following Brief Description of the Drawings and Detailed Description.

BRIEF DESCRIPTION OF DRAWINGS

A more particular description of the invention briefly summarized above may be had by reference to the embodiments, some of which are illustrated in the accompanying drawings. It is to be noted, however, that the appended drawings illustrate only typical embodiments of this invention and are therefore not to be considered limiting of its scope, for the invention may admit to other equally effective embodiments. Thus, for further understanding of the nature and objects of the invention, references can be made to the following detailed description, read in connection with the drawings in which.

DETAILED DESCRIPTION

The following discussion relates to various embodiments of a golf club head and associated method of manufacture. It will be understood that the herein described versions are examples that embody certain inventive concepts as detailed herein. To that end, other variations and modifications will be readily apparent to those of sufficient skill. In addition, certain terms are used throughout this discussion in order to provide a suitable frame of reference with regard to the accompanying drawings. These terms such as "upper", "lower", "forward", "rearward", "interior", "exterior", "front", "back", "top", "bottom", "inner", "outer", "first", "second", and the like are not intended to limit these concepts, except where so specifically indicated. The terms "about", "generally", or "approximately" as used herein may refer to a range of 80%-125% of the claimed or disclosed value. With regard to the drawings, their purpose is to depict salient features of the golf club head and associated method of manufacture and are not specifically provided to scale.

Figure 1A:
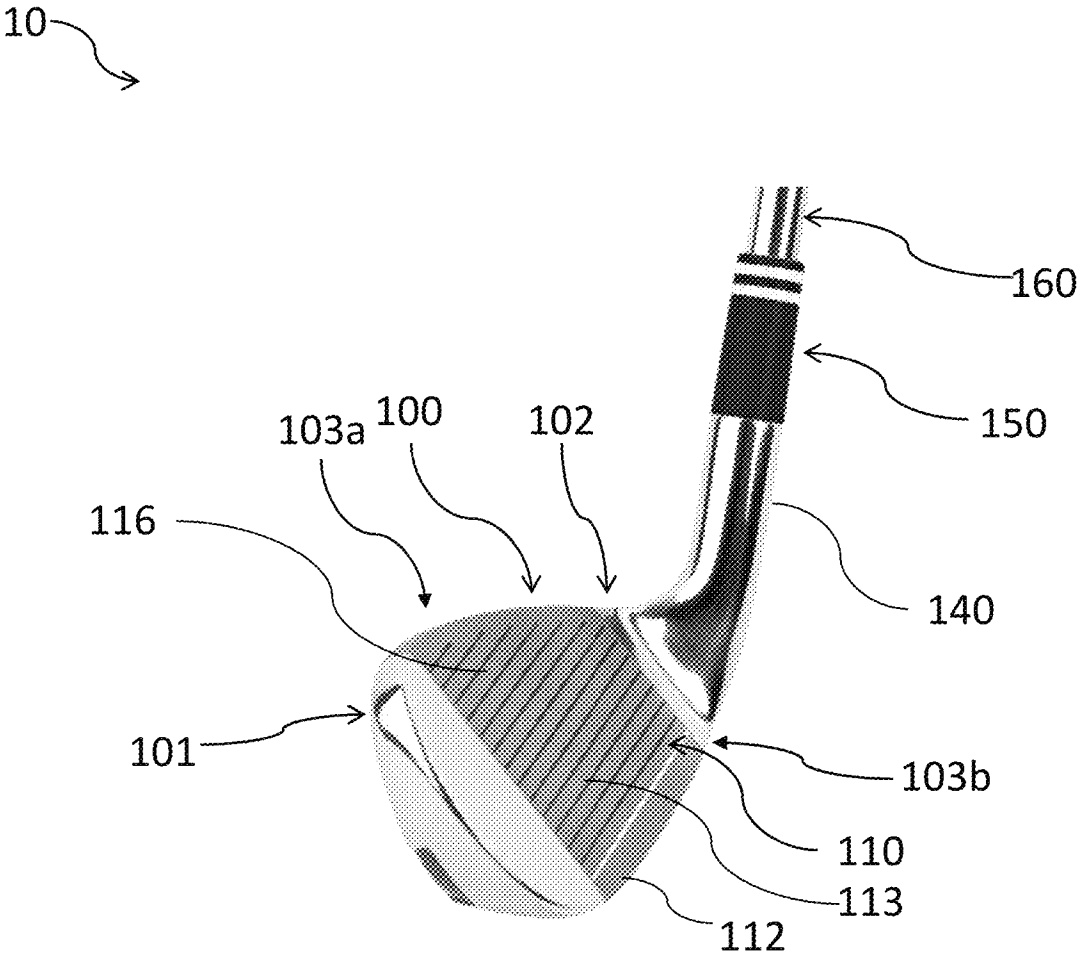
FIG. 1A illustrates a perspective front view of an embodiment of a golf club.

As shown in FIG. 1A, a golf club 10 generally comprises a shaft 160 extending between a grip (not shown) at one end and a club head 100 at an opposing end. The point where the shaft 160 couples to the club head 100 may be covered or otherwise protected by a ferrule 150. Club heads 100 are commonly manufactured from 303 stainless steel or 10-20 raw carbon steel. The figures depict club heads 100 from the family of wedge clubs such as a pitching wedge, gap wedge, sand wedge, and lob wedge. The family of wedge clubs comprises golf clubs with at least 45° of loft and the invention will be described herein with respect to this family of golf clubs. However, several of the disclosed concepts can be applied to club heads having less than 45° of loft.

Figure 1B:
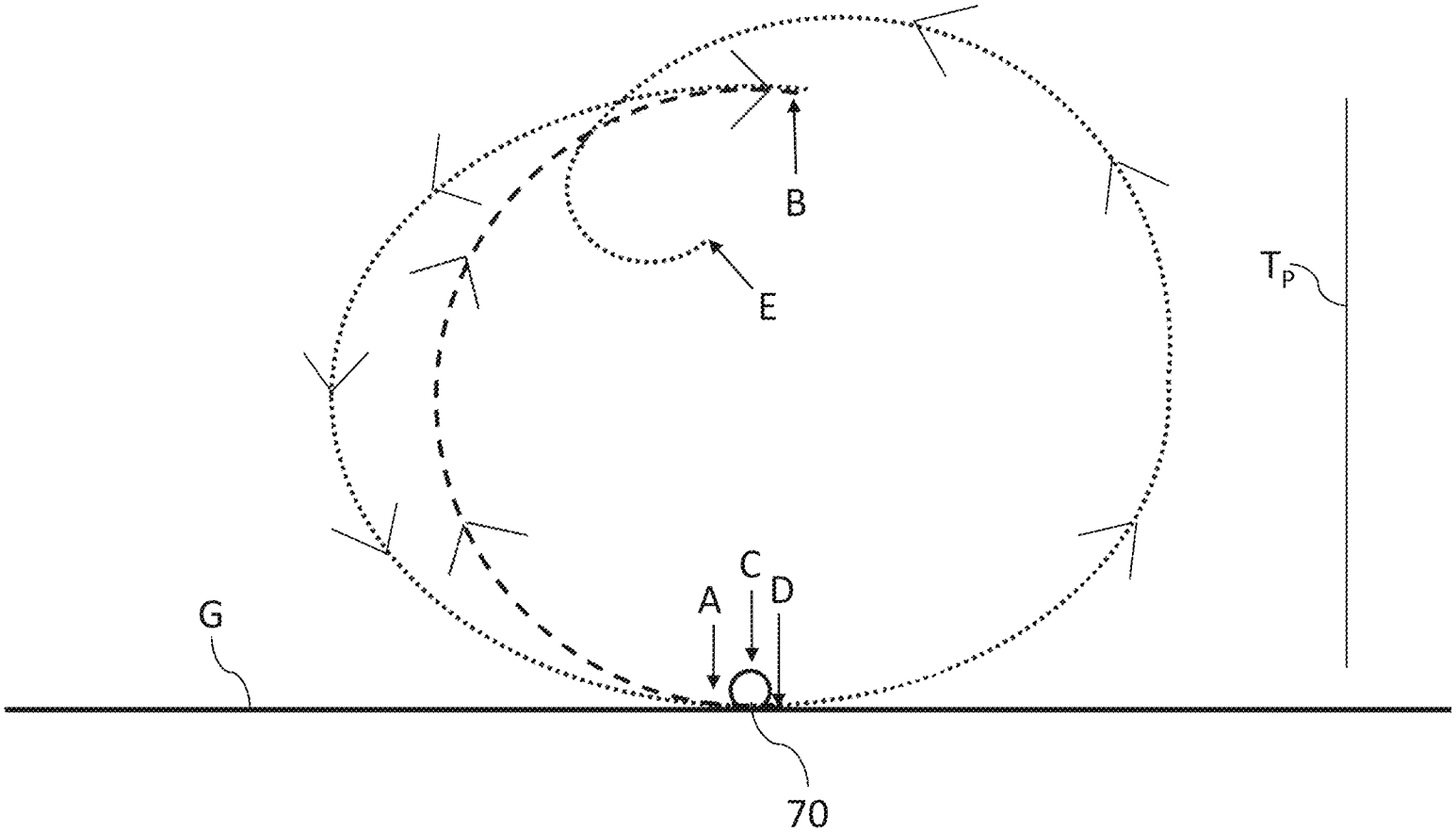
FIG. 1B illustrates a schematic view of a golf swing.

FIG. 1B schematically depicts movements associated with a typical golf swing. The diagram illustrates the golf swing generally as comprising a back swing and a down swing as indicated by two different broken lines with directional indicators. The broken lines generally track movement of the club head 100, and more specifically a club head body 103 (FIG. 3) during the golf swing where a golf ball 70 is being hit towards a target plane $T_P$. The golf swing begins at point A when the club head 100 addresses the golf ball 70 by grounding the club head 100 immediately behind the golf ball 70. The club head 100 is then drawn back about the player's body to point B, which is generally above the player's shoulders. The movement from points A-B represent the back swing. At point B, the player brings the club head 100 back around their body and into contact with the golf ball 70 at point C and then to the bottom of the golf swing at point D. The movement from points B-C-D represent the down swing. After reaching the bottom of the down swing (point D), the player continues to move the club head 100 past point D and around the other side of the players body to point E, which may generally be positioned below the players shoulders. The movement from points D-E represent the follow through.

The current golf club heads on the market use a form of weight distribution where the perimeter 50 of the body 103 is made to be heavier than the inner space 55 in order to make the club head 100 more forgiving to the golfer. This form of perimeter weighting however tends to result in "hot spots", which cause imprecise shots to occur when the golfer has an ideal lie or placement of the golf ball. The foregoing disclosure describes a method and representative embodiment of golf club heads that eliminate the use of "hot spots" cause by perimeter weighting and increase precision and ball spin using traditional ball speeds and launch characteristics. Embodiments of golf club heads will further be described that are configured to decrease the drag of the club head during the down swing (FIG. 1B) movement leading to a faster club head speed at the point of contact with the golf ball 70 (point C of FIG. 1B), which results in the golfer hitting the golf ball 70 farther.

Referring generally now to FIGS. 1A and 2-4E the club head 100 comprises a body 103 having a body top 103*a* and a body bottom 103*b*. The body 103 extends from a second end or toe end 101 to first end or heel end 102 and further comprises a forward facing surface or a forward face 110 defining a contact portion area or contact portion 116 comprising a plurality of grooves 113. A leading edge 112 is positioned proximate the bottom 103*b* of the body 103. A rear face or rearward facing surface or rear surface 120 is generally opposing the forward facing surface 110 and defines a trailing edge 114. The sole 106 of the club head 100 is generally defined between the leading edge 112 and the trailing edge 114.

Figure 1C:
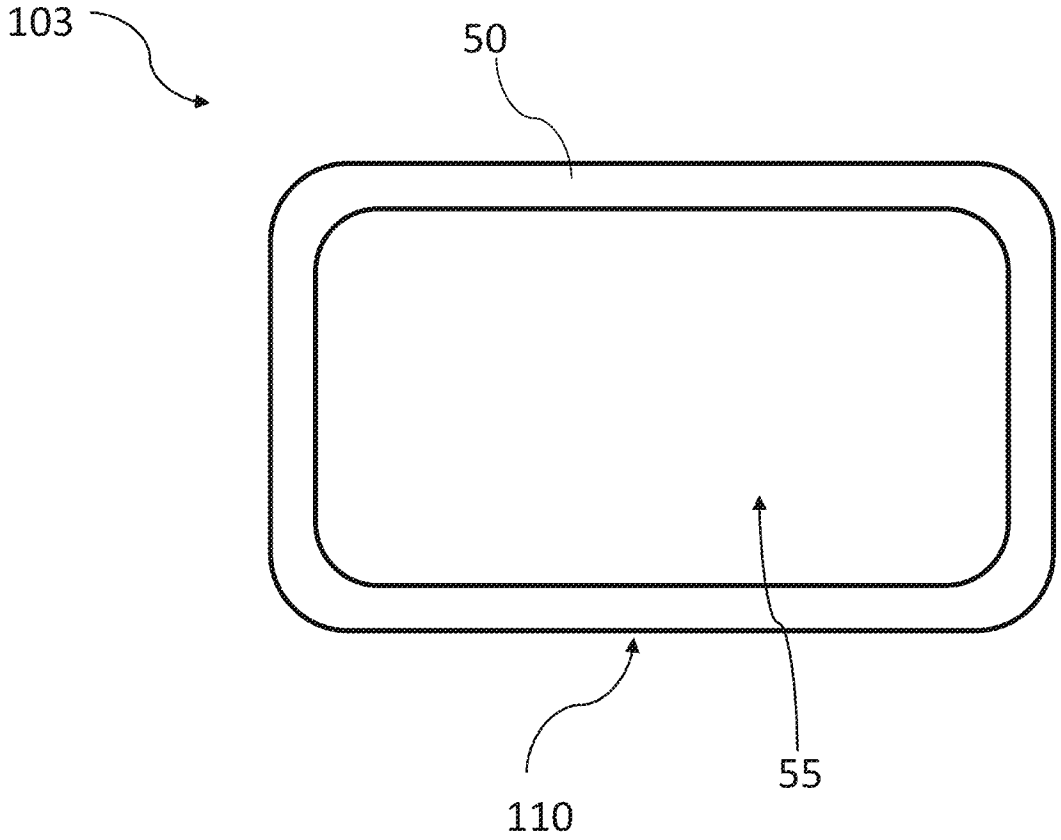
FIG. 1C illustrates a schematic depiction of a perimeter weighted golf club head of a golf club.
Figure 2:
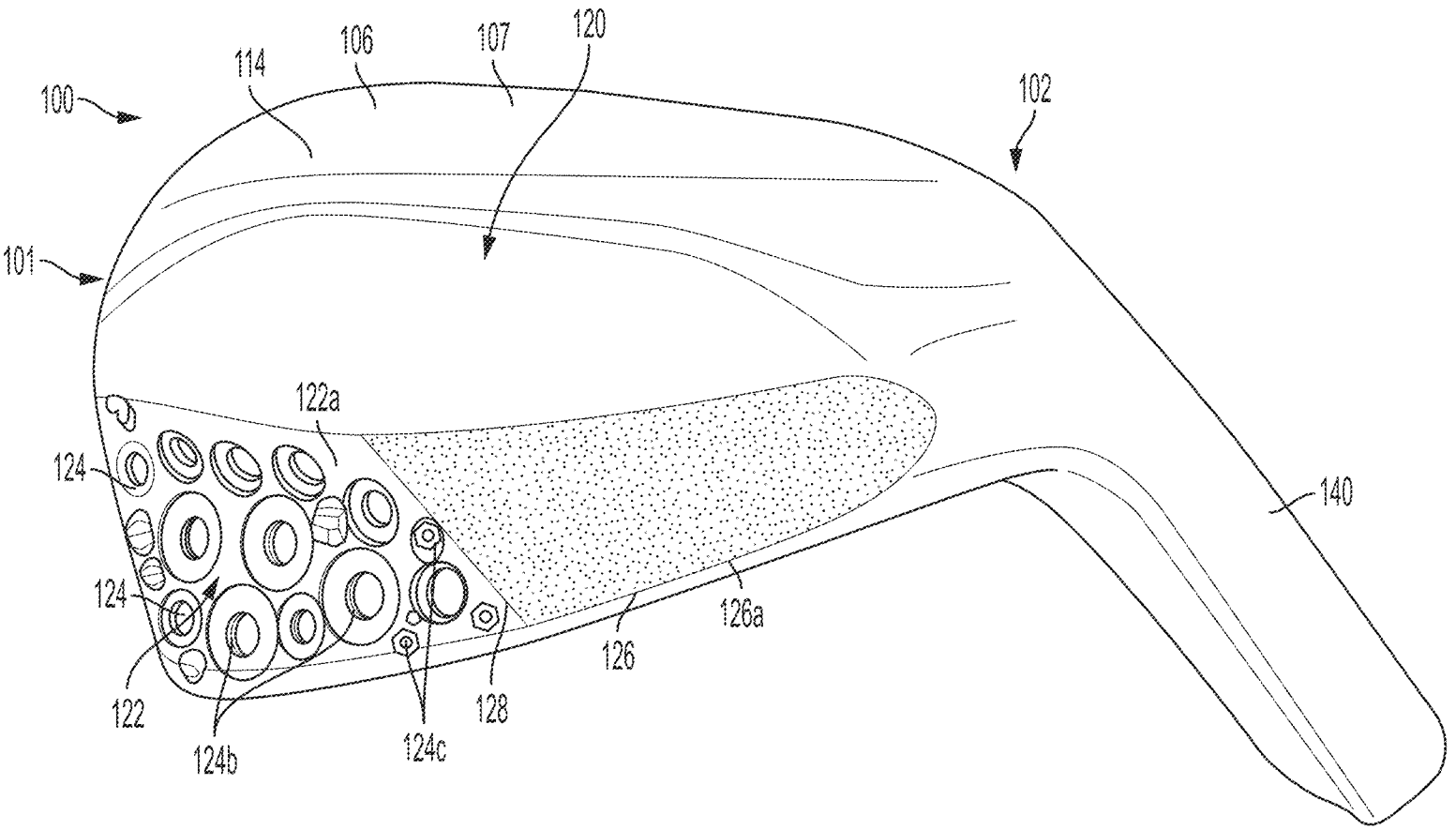
FIG. 2 illustrates a perspective rear view of an embodiment of a golf club head.

The embodiment of the rear surface 120 of the club head 100 shown in FIG. 2 includes a first portion 122 and a second portion 126. The first portion 122 defines one or more weight shifting elements 123 positioned proximate a toe end 101 of the rearward facing surface 120 of the club head 100. The one or more weight shifting elements are configured to remove weight from the toe end 101 of club head 100 as compared to a stock club head or a club head 100 without the one or more weight shifting elements 123. The one or more weight shifting elements 123 shift the center of gravity (COG) of the club head 100 such that the COG is positioned closer to the hosel 140. Referring to FIG. 1C, the one or more weight shifting elements 123 enable the COG to be shifted without using perimeter weighting and therefore generally preserving the club weight behind the contact portion 116 of the forward facing surface 110. In an embodiment, the weight shifting elements 123 are may be one or more recesses or depressions 124 that are filled with a different that the material comprising the body 103 of the club head 100. In another embodiment, the filling material that is less dense than the material comprising the body 103 of the club head 100, such as glass, plastic, or a gaseous material.

As shown, the one or more depressions 124 have perimeters that are generally circular or are comprised of concentric circles with depths that vary, however in other embodiments the one or more depressions 124 may have a perimeter that is non-circular in shape. In an embodiment, the depth of the one or more depressions 124 is between about 0.03 to about 1.0 inches. In a preferred embodiment, the depth of the one or more depressions 124 is between 0.125 and 0.5 inches. Other embodiments of the club head 100 may define depressions 124 with perimeters that are polygonal, semicircular, or any other desired shape. The depths of the depressions 124 vary according to the extent the COG is desired to be shifted (i.e., the desired amount of weight to be removed). As shown, the one or more weight shifting elements 123 may be formed by carving, etching, boring, or otherwise removing material from the first portion surface 122*a* of the reward facing surface 120. In another embodiment, the one or more weight shifting elements 123 are formed or molded as part of the club head 100 during manufacturing. In still another embodiment, at least one weight shifting element 125 (FIG. 4D) may be positioned at a heel end 102 of the rearward facing surface 120 of the body 103 in order to add weight to the heel end of the body.

Figure 3:
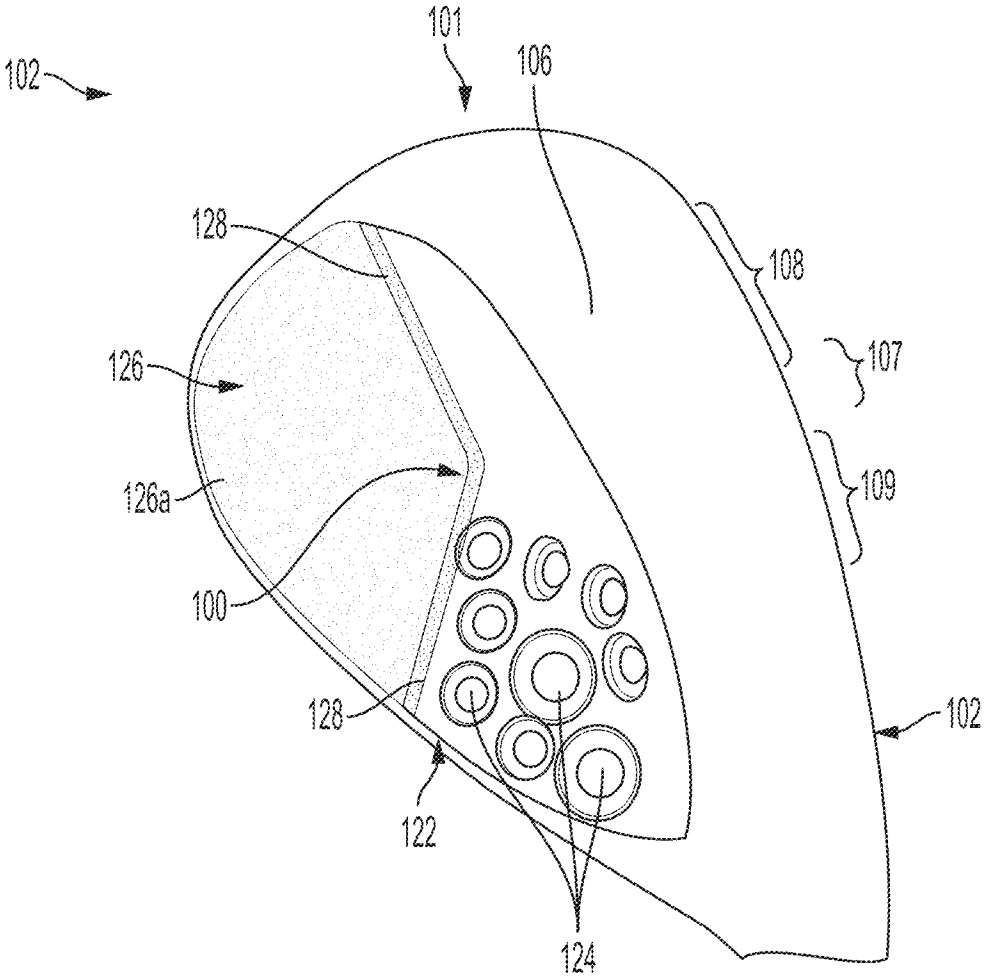
FIG. 3 illustrates a perspective rear view of another embodiment the golf club head.

The second portion 126 of the rear surface 120 of the club head 100 includes a second portion surface 126*a* that is sunken or recessed relative to the first portion surface 122*a*. In an embodiment, the second portion surface 126*a* is sunken from about between 0.03 inches to about 1.0 inches relative to the first portion surface 122*a*. In a preferred embodiment, the second portion surface 126*a* is sunken 0.25 inches below the first portion surface 122. As shown in FIGS. 2-3, the second portion surface 126*a* is at least partially surrounded by a shoulder 128 that acts to delimit the first portion 122 and the second portion 126. The second portion surface 126*a* may be textured as is shown in FIGS. 2-3, or may be relatively smooth and polished.

The first portion 122 and the second portion 126 of the rear surface 120 are configured to alter the COG of the club head as compared to the same club head without these features. For example, shifting the COG of the club head 100 towards the heel end 102 promotes a draw spin on the golf ball 70 (FIG. 6), which would counteract a player's swing that produces a slice, or a ball flight that curves to the right in a right handed player (or to the left in a left handed player). Moving the COG towards the toe end 101 of the club head 100 would have the opposite effect. The first portion 122 and second portion 126 of the rear surface 120 may also be configured to raise the COG of the club head 100 in order to increase the spin imparted on the golf ball 70 (FIG. 6) when it is hit. FIG. 3 shows an alternate embodiment of the rear surface 120 where the first portion 122 is positioned proximate the heel end 102 and the second portion 126 is positioned proximate the toe end 101. In other embodiments, the first portion 122 may be flanked by the second portion 126 or vice-versa.

Figure 4A:
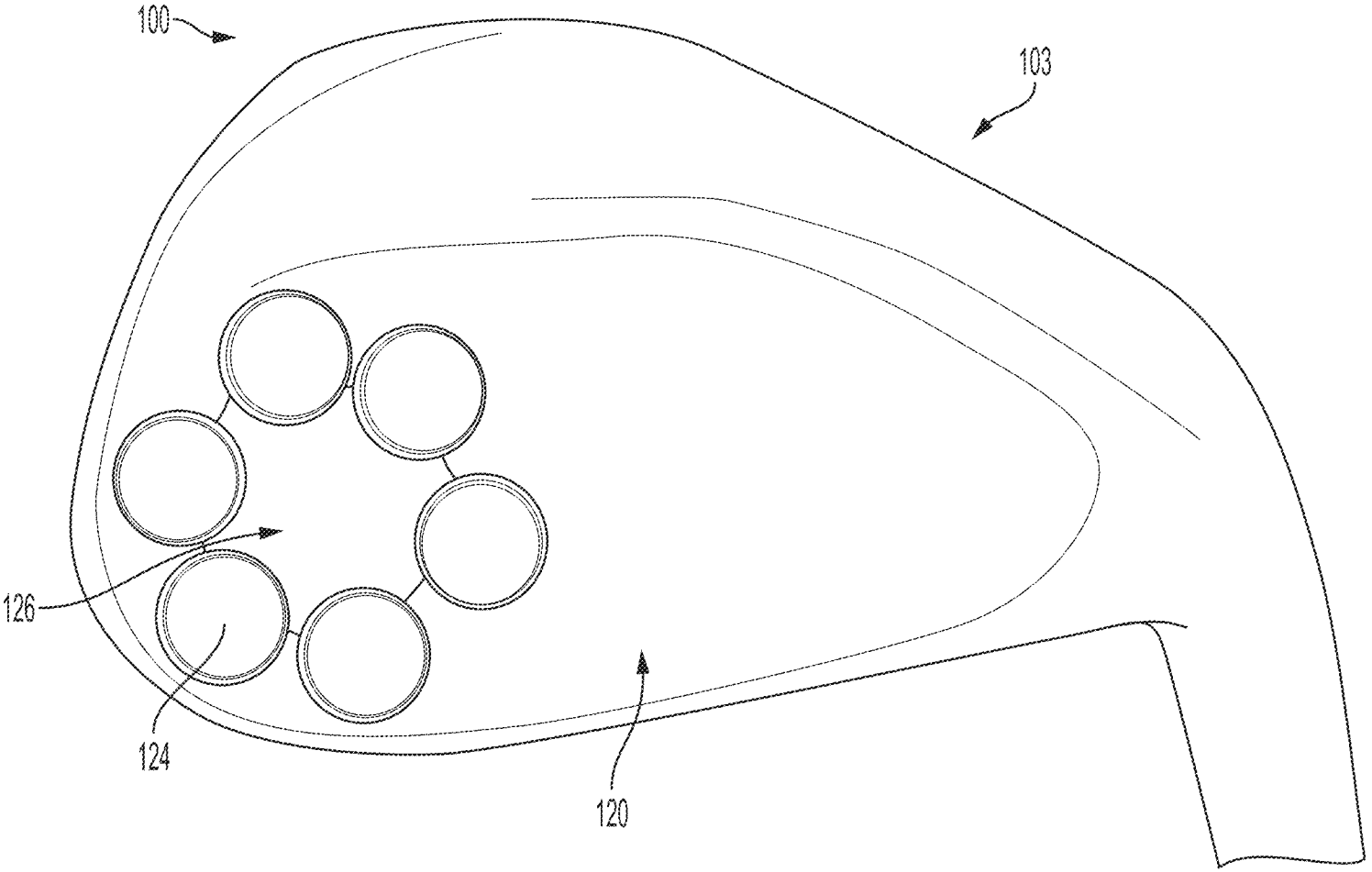
FIG. 4A illustrates a perspective rear view of another embodiment the golf club head.
Figure 4B:
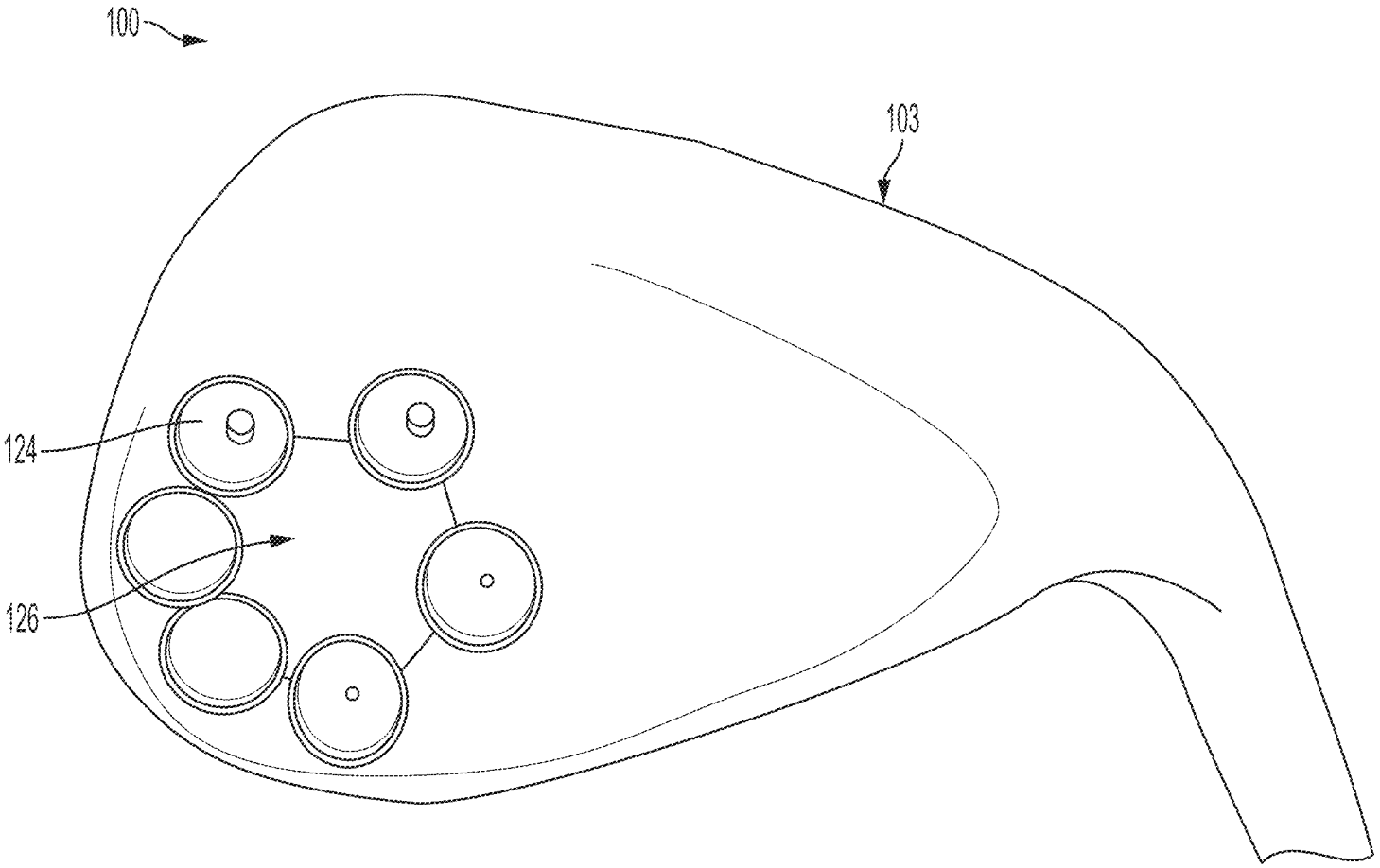
FIG. 4B illustrates a perspective rear view of an embodiment the golf club head.
Figure 4C:
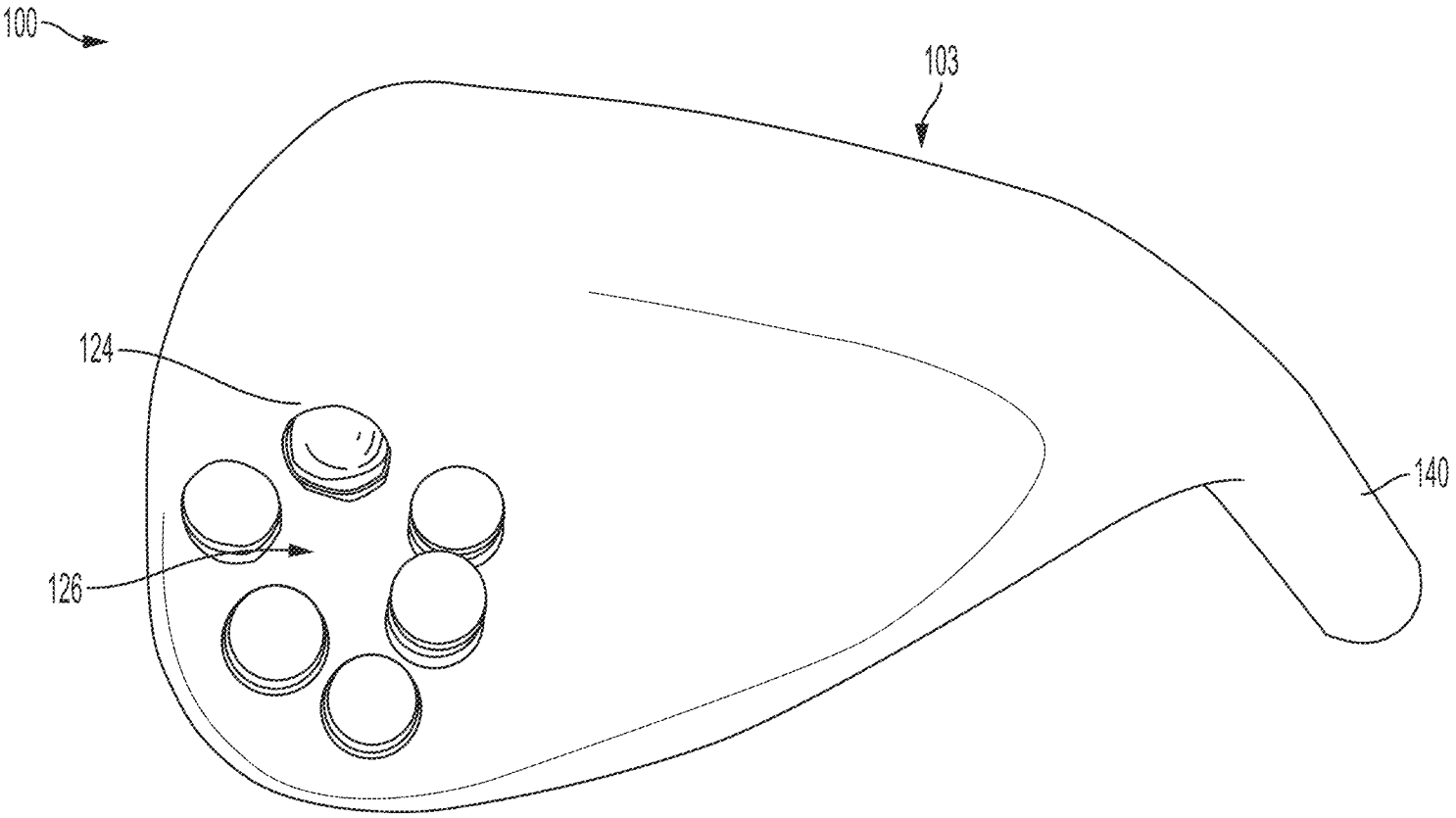
FIG. 4C illustrates a perspective rear view of an embodiment the golf club head.

FIGS. 4A-4C illustrate other embodiments where the first portion 122 generally surrounds the second portion 126. The combination of the first and second portions 122, 126 enable precise removal of club head weight and adjustment of the COG of the club head 100. The weight shifting elements 123, or depressions 124 in this embodiments, may act as a means of bulk removal of club head weight and the recessed nature of the second portion surface 126*a* may act as a means for a more incremental or fine removal of club head weight. The second portion 126 as shown in FIGS. 4A and 4B is generally circular in shape, however as shown in FIG. 4C, the second portion 126 may be configured as a shape other generally circular, such as a shamrock or a company logo. In addition, one skilled in the art would realize that the number and size of the weight shifting elements 123 may vary depending on the shape and size of the club head 100 as well as the desired ball flight by the player.

Figure 4D:
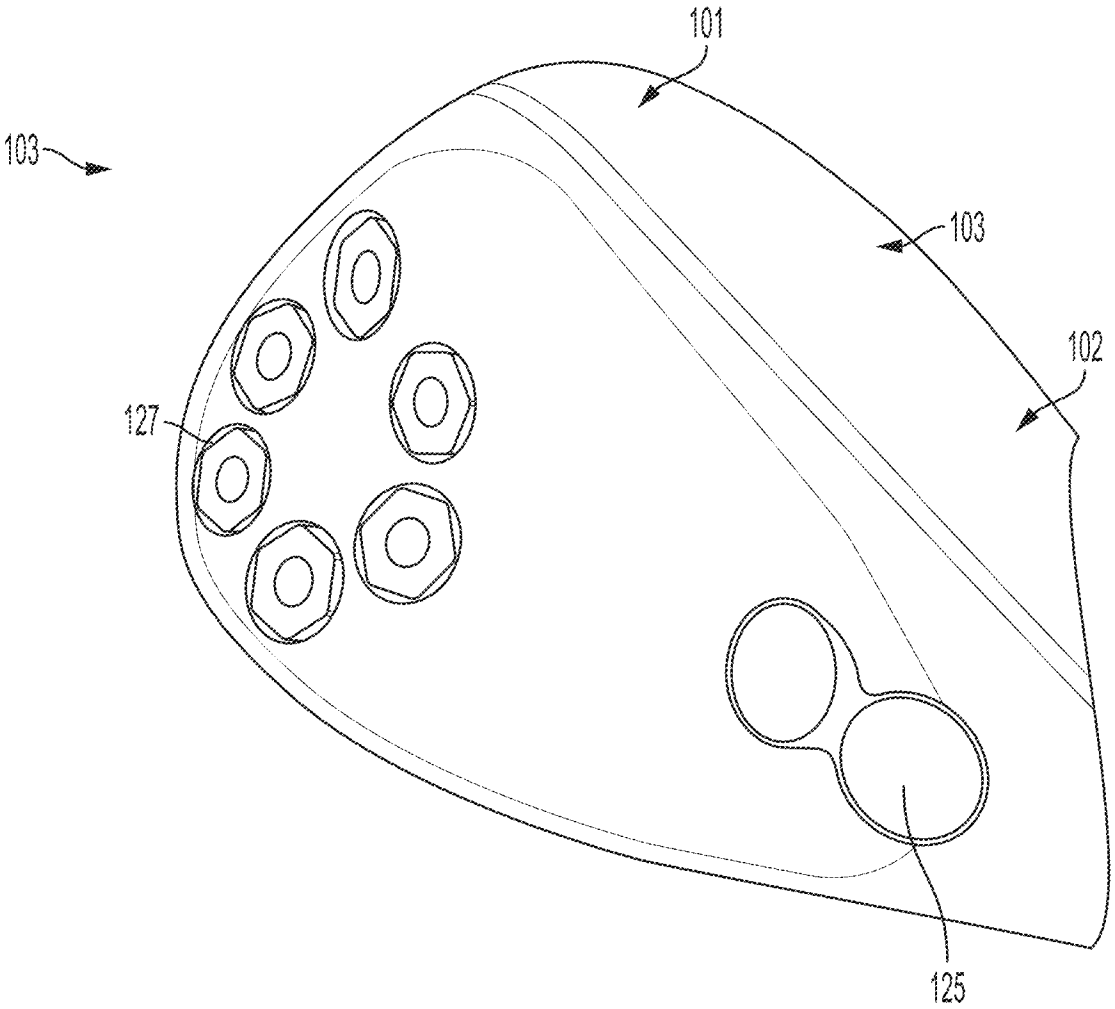
FIG. 4D illustrates a perspective rear view of an embodiment the golf club head.
Figure 4E:
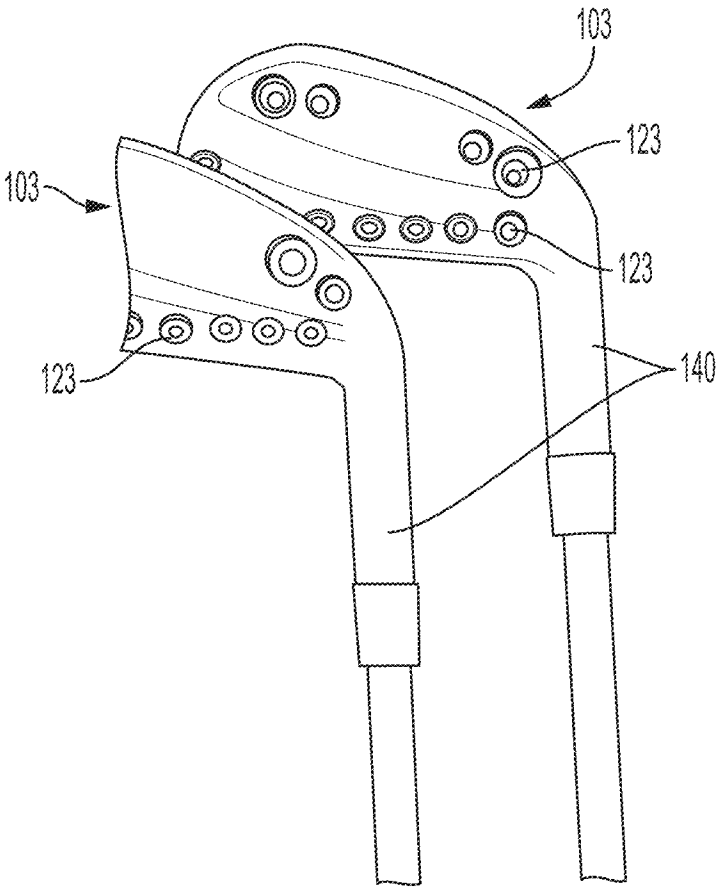
FIG. 4E illustrates a perspective rear view of another embodiment the golf club head.

Referring to the embodiments of golf club heads 100 shown in FIGS. 4D-4E, the weight shifting elements 123 are shown as depressions 124 and a second portion 126 as described above may not be defined on the rearward facing surface 120. In an embodiment, the one or more depressions 124 may be subsequently filled with a material that is different from the club head 100 for the purposes of increased performance and/or aesthetics. As shown in FIG. 4D, the one more depressions 124 are filled with a plug 127 comprised of a material that is less dense than the material comprising the club head 100 in order to adjust the COG of the club head 100. In an embodiment not shown, a shock proof or impact resistant glass may be used to fill in the one or more depressions 124. The glass may be colored or multicolored and may have one or more aesthetic inclusions such as beads, gems, wire, metal flakes, coins, or any other suitable element or combinations of that may be used to increase the aesthetic appeal of the club head 100. In another embodiment, a border of precious or semi-precious metal may be installed around the glass. The filling material may be secured in the one or more depressions 124 using an adhesive bond (such as epoxy), a welded joint, a mechanical bond, or any other suitable method of securing the filling material in the one or more depressions 124. In an embodiment not shown, images may also be placed within the one or more recesses 124 that can be seen through the glass or other material. Accordingly, the recesses 124 and their associated fillings may be further used to adjust the COG of the club head 100 as well as for aesthetic purposes. Filling the one or more recesses 124 may also act to increase the aerodynamics of the club head 100 as it is moved through the air during the back swing movement of the golf swing.

In another embodiment not shown, the ferrule 150 of the golf club 10 may be weighted in order to affect the swing weight of the club head 100 and shift the COG of the club head 100. In this embodiment, the ferrule 150, the first portion 122, and the second portion 126 of the rear surface 120 work together as a balancing system that shift the COG of the club head 100 and result in a club head 100 with increased precision without the use of perimeter weighting. As with the one or more recesses 124, the ferrule 150 may be comprised of impact resistant glass, precious metal, wire, a composite, a non-precious metal (such as copper or Damascus steel), or any other suitable material or combination of materials configured to modify the swing weight while also providing the desired aesthetic characteristics.

Referring to the embodiment in FIG. 4E, the one or more weight shifting elements 123, such as the recesses 124, may be positioned or defined at various locations on the rear surface 120 of the club head 100 depending on the shape of the club head 100 and the desired performance characteristics. In embodiments where the weight shifting elements are recesses 124, they may vary in size and depth. Like FIG. 4D, the embodiments shown in FIG. 4E do not define a second portion 126 as was described in previous embodiments.

Figure 4F:
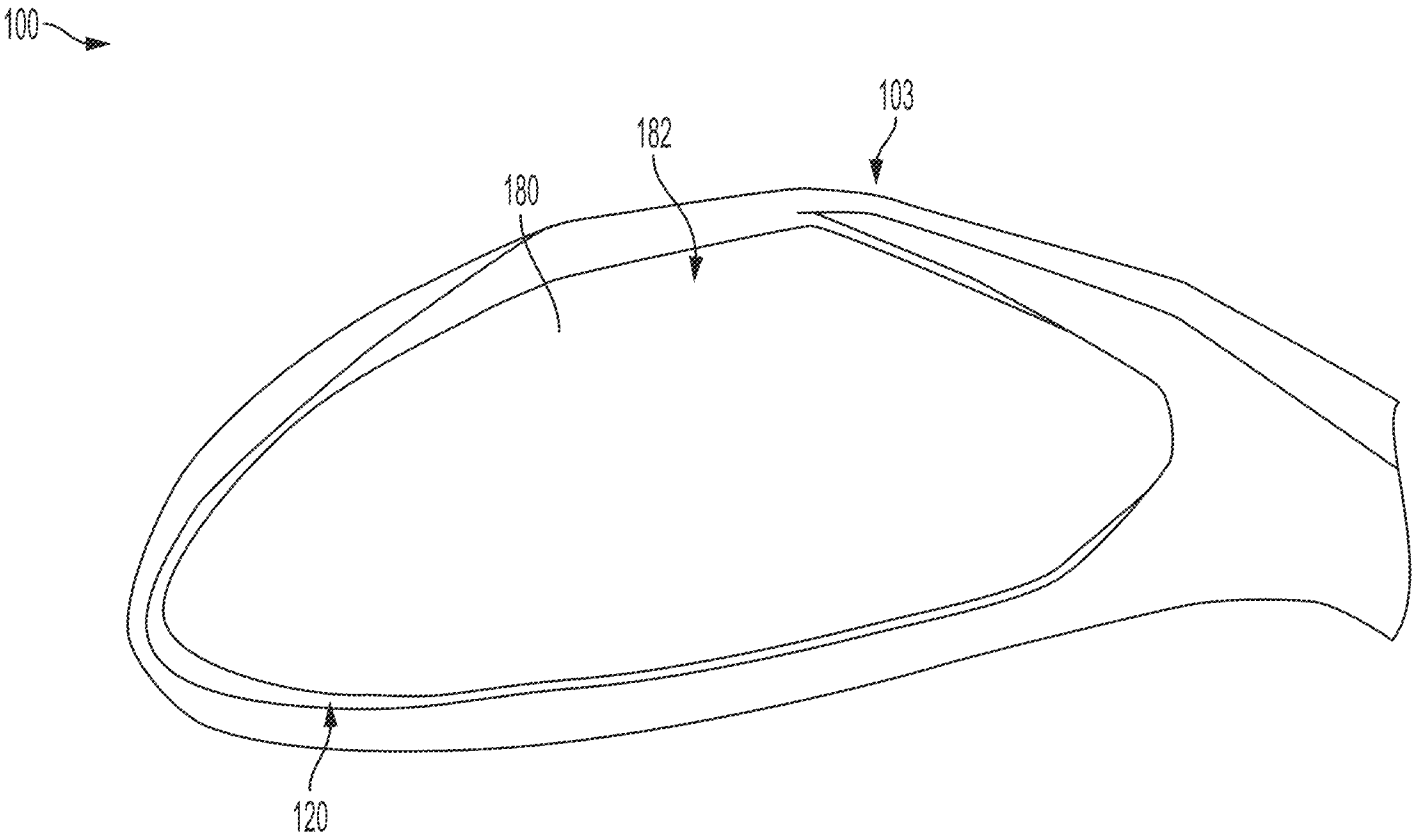
FIG. 4F illustrates a perspective rear view of another embodiment the golf club head.

In another embodiment shown in FIG. 4F, additional material may be added to at least a portion of the rear surface 120 of a golf club head 100. The added material 180 may comprise one or more metals such as copper or brass. As shown, added material 180 may be used to create a "flat" rear surface 120 of the body 103. This differs from the perimeter weighted golf club heads currently being sold, which have one or more cavities defined in the center portion 182 of the rear surface 120 (such as the rear surface 220 of FIG. 8), which removes weight from the area behind the forward facing surface 110 and specifically the contact area 116. Accordingly, the embodiment of 4F further inhibits the formation of "hot spots" on the forward facing surface 110.

Figure 5:
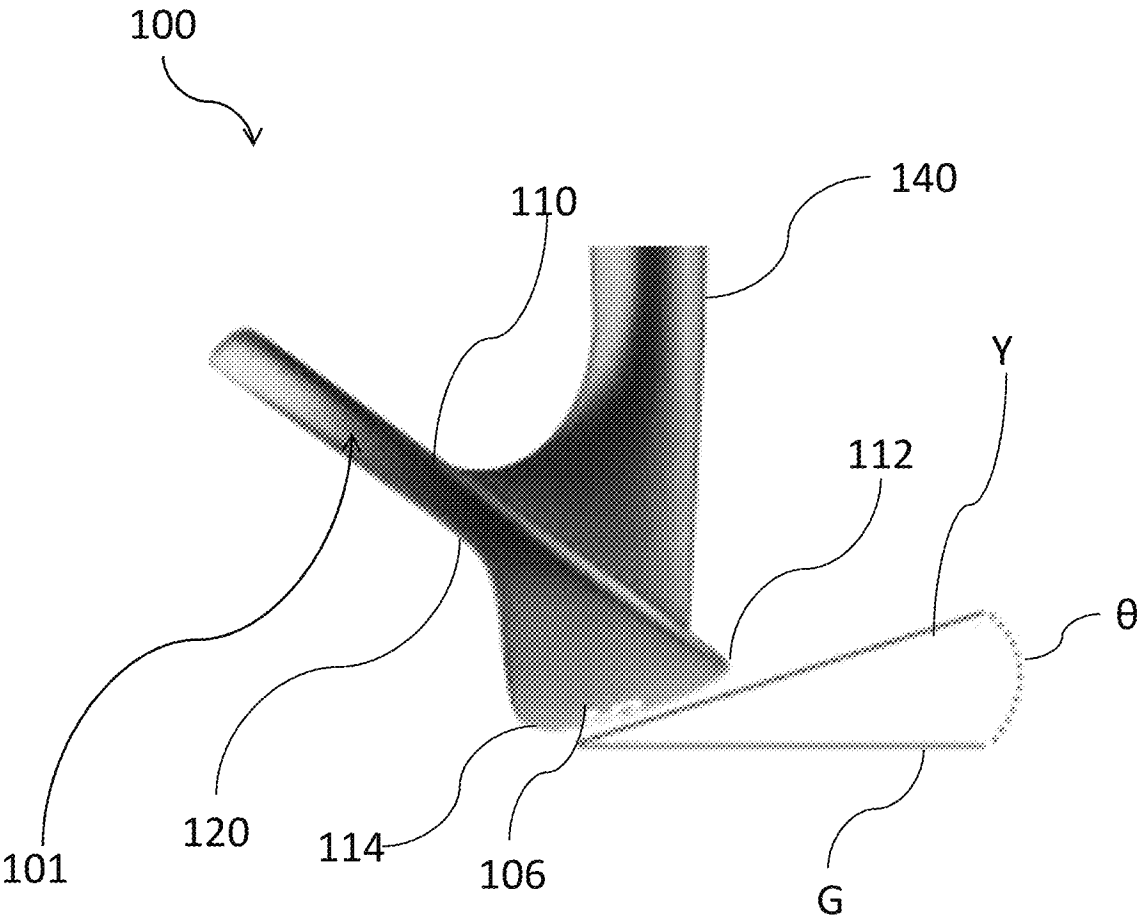
FIG. 5 illustrates a close-up side view of an embodiment of the golf club head.
Figure 6:
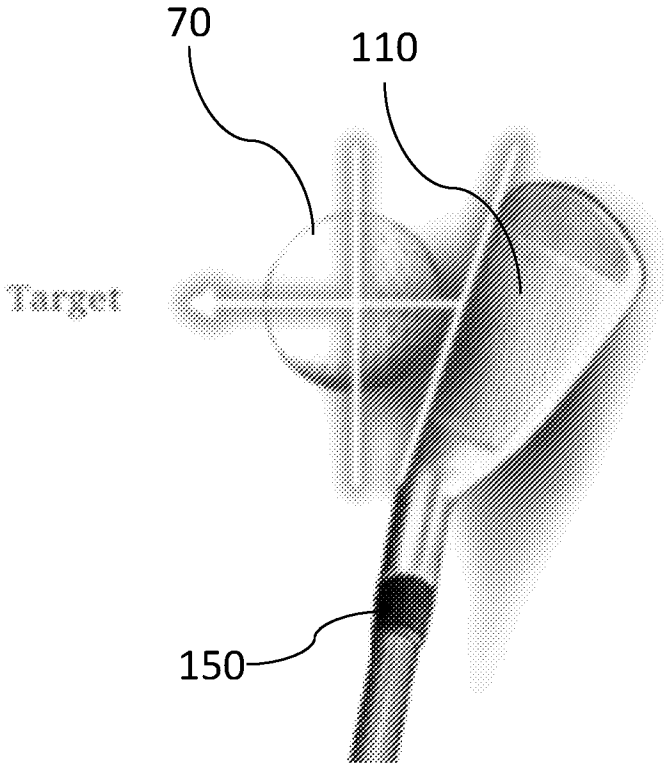
FIG. 6 illustrates a perspective top view of an embodiment of the golf club head in an open position.

Turning now to FIGS. 3 and 5-6, the sole 106 of the club head 100 is polished and generally smooth to reduce the friction between the club head 100 and the turf or ground G. The angle θ between the sole 106 of the club head 100 (along an axis Y) with respect to the ground G indicates the level of bounce that the club head 100 produces. In an embodiment of the club head 100, the bounce varies from about 5° to about 20° depending on the position of the toe end 101 and heel end 102 relative to the ground G. In the embodiments shown in FIGS. 2-3, the static bounce (the value of the angle θ when addressing the golf ball 70 at point A of FIG. 1B) is about 12° at a center portion 107 of the sole 106 when the golf club 10 is held such that the center portion 107 of the sole 106 is square to the ground G. The static bounce decreases to around 5° when the golf club 10 is held such that the center portion 107 is not square with the ground G and the heel end surface 109 of the sole 106 of the club head 100 is in contact with the ground G. When the club head 100 is in the open position such that the center portion 107 is not square with the ground G and toe end surface 108 of the sole 106 of the club head 100 is raised off the ground G (i.e., the forward face 110 points to the right of the target in the case of a right handed player) as shown in FIG. 6, the static bounce is less than 5° but the effective bounce (the amount of bounce on the club head 100 when the club head 100 contacts the golf ball 70 at point C (FIG. 1B) of the golf swing) is about 20°. This configuration of the sole 106 in combination with the moving the COG towards the hosel 140 of the club head 100 using the one or more weight shifting elements 123 as was previously described dramatically increases ball spin on short wedge shots (e.g., ≤50 yards) without changing the ball speed (i.e., the speed at which the ball releases from the contact portion 116 of the club head 100).

The bounce angles θ produced by the sole 106 in conjunction with the COG moved towards the hosel 140 optimizes the spin imparted on the golf ball 70 (FIG. 6). The club head 100 as described has been shown to produce ball spin up to around 1100 rpm. When the disclosed club head 100 is in the open position as described above and shown in FIG. 6, a golfer is able to impart more spin on the golf ball 70 as a result of the COG being moved farther away from the toe end 101 of the club head 100. Accordingly, the further away the ball is struck from the COG, the more the ball speed decreases and the greater the spin that is imparted on the ball at impact (point C of FIG. 1B) due to a phenomenon known as gear effect. This allows the golfer to swing faster and impart more spin on the golf ball from the same distance than if they were to hit a golf club, such as a wedge type club, with a standard club head. For example, if a golfer hits one golf ball to a target 50 yards away using the disclosed club head and a second golf ball from an identical location using a standard wedge type club head, the golfer is able to swing the club head about 5 mph faster than with the standard wedge club head. The leading edge 112 of the club head 100 may be further configured to be sharp (also shown at 212 of FIG. 9) in order to enable the club head 100 to dig into the ground G at the bottom of the golf swing (point D of FIG. 1B), however the bounce angle θ prevents the club head 100 from getting stuck in the ground G or from digging too deep, both of which result in "fat" golf shots.

Figure 7:
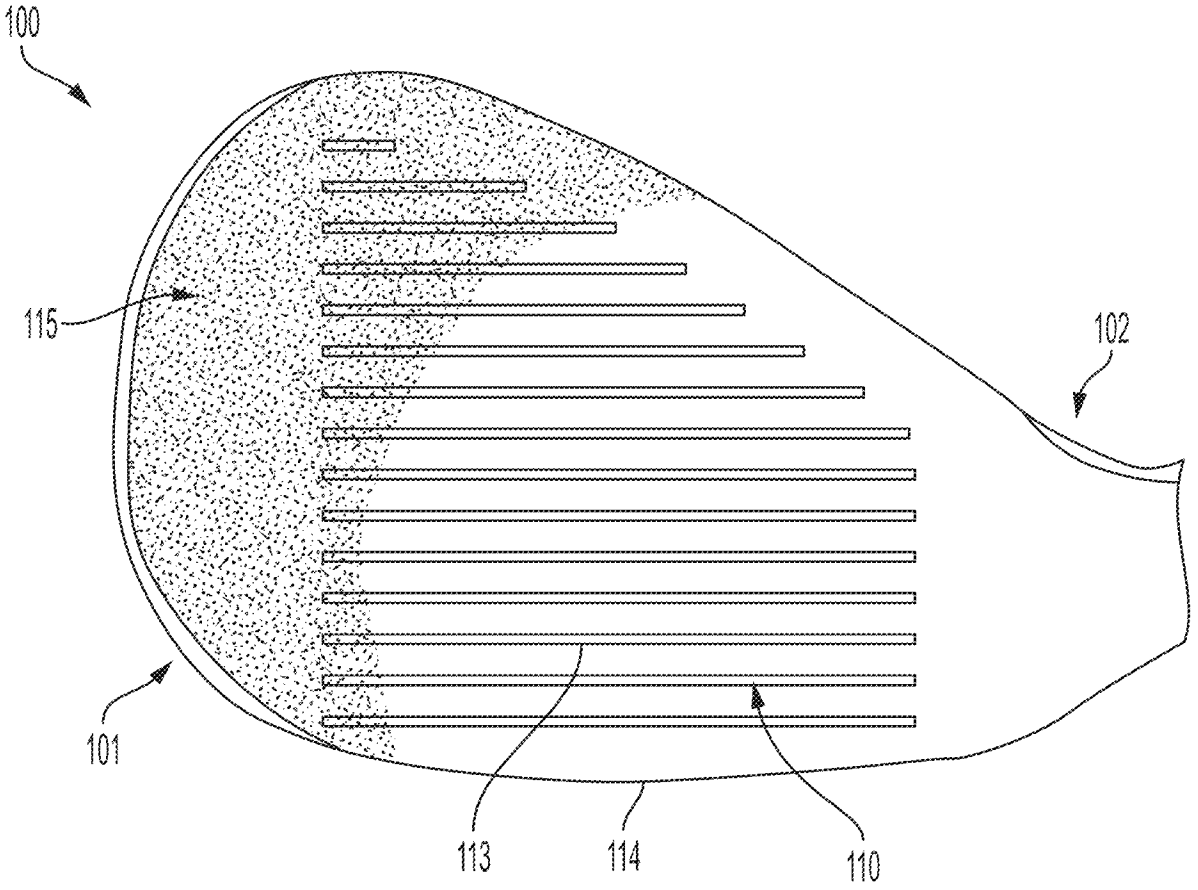
FIG. 7 illustrates a perspective view of an embodiment of the forward face of the golf club head.

Referring to FIGS. 1 and 7, the forward face 110 of the club head 100 comprises a plurality of grooves 113 configured to facilitate removal of water, dirt, and debris from the forward face 110. As shown in the embodiment of FIG. 7 specifically, the forward face 110 comprises an area 115 proximate the toe end 101 configured to increase friction between the forward face 110 and the golf ball 70 (FIG. 6). As shown, the area 115 comprises a textured or rough surface with a plurality of surface features. The surface features may be identical in shape and spacing or they may vary in their shape, size and/or spacing. In an embodiment, the surface features may be carved, etched, or otherwise scored into the forward face 110 as a post manufacturing process. In another embodiment, the surface features of the area 115 (FIG. 7) may be formed as part of the forward face 110 of the club head 100.

Figure 8:
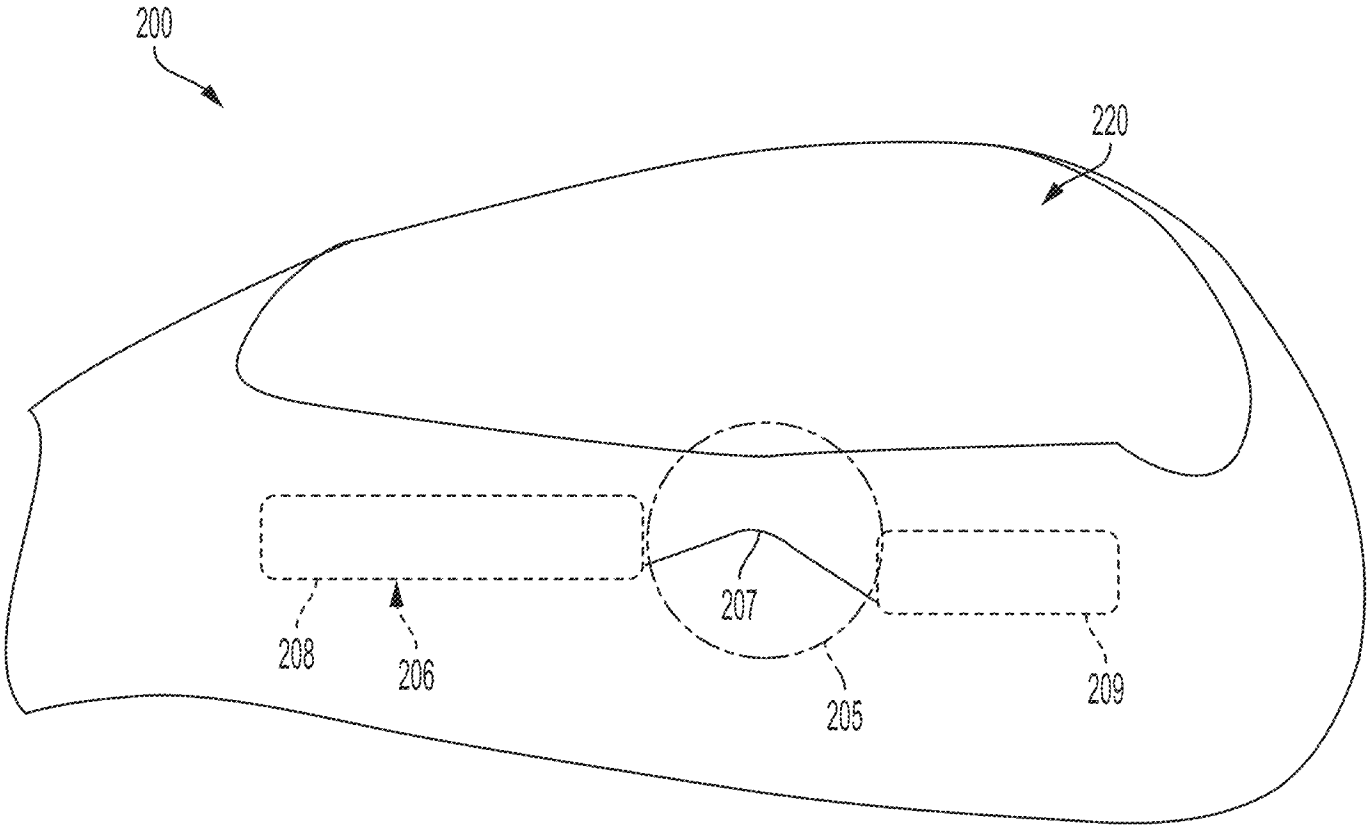
FIG. 8 illustrates a perspective view of an embodiment of a sole of the golf club head.
Figure 9:
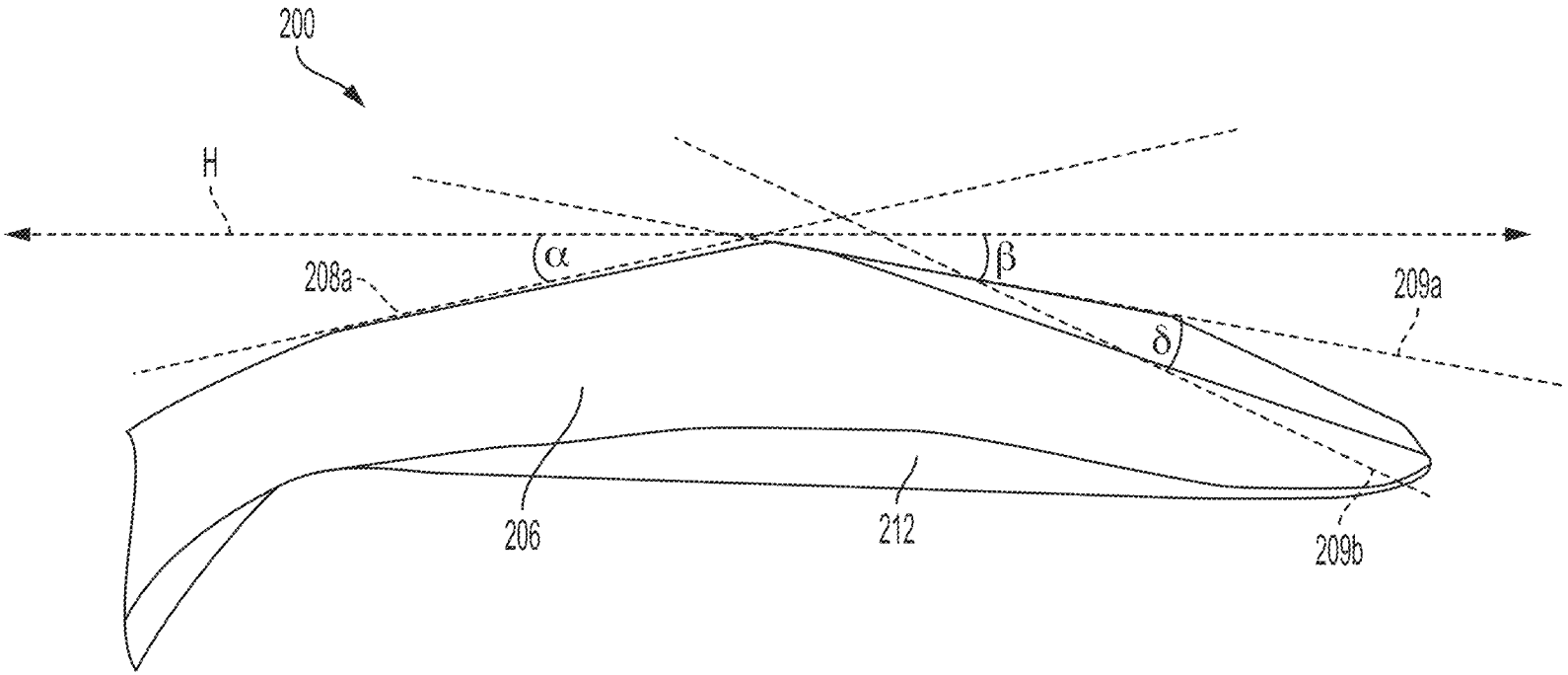
FIG. 9 illustrates a perspective view of an embodiment of the sole of the golf club head.

Turning now to FIGS. 8 and 9, which illustrate an embodiment of the club head 200 where the sole 206 has been shaped or formed to include a raised portion 205 defining an apex 207. As shown, the sole 206 generally slopes away from the apex 207 in a heel region 208 and a toe region 209. Each of the heel and toe regions 208, 209 may comprise at least one surface that is angled with respect to a horizontal axis H. As shown, the heel region 208 comprises a first heel region surface that extends along a first heel surface plane 208*a*. The first heel surface plane 208*a* intersects the horizontal axis H at an angle α that is about 15°. In other embodiments, the heel region 208 may further comprise a second heel surface that extends along a second heel surface plane. The toe region 209 comprises a first toe region surface that extends along a first toe region surface plane 209*a* and a second toe region surface that extends along a second toe region surface plane 209*b*. The first toe region surface plane 209*b* intersects the horizontal axis H at an angle β that is about a 15° and the second toe region surface plane 209*b* intersects the first toe region surface plane 209*b* and an angle δ that is about 15°. As shown, the angles α, β, and δ are all about 15°, however in other embodiments, at least one of the angles α, β, and δ is a different value than the other to angles. The configuration of the heel region 208 and the toe region 209 assist in stabilizing the club head 200 during the golf swing which further improves the precision of the golf shot experienced by the player.

It has further been discovered that forming the hitting surface or contact portion 116 from different metal alloys can further improve spin and launch characterizes of the golf ball 70 (1A). Club head bodies 103 are generally comprised of 303 stainless steel, which is a chromium-nickel stainless steel modified by the addition of selenium or sulphur, as well as phosphorus, to improve machinability and non-seizing properties, or 1020 carbon steel. The ratio of the coefficient of friction of 303 stainless to the coefficient of friction of urethane ratio (the material covering the golf ball) is about 0.3 (13.779/45.93) and the ratio of the coefficient of friction of 1020 carbon steel to the coefficient of friction of urethane ratio is about 0.4 (18.372/45.93). The difference of 0.1 between the two ratios equates to about an extra 300 rpms of golf ball spin for the 1020 carbon steel at the same ball speed as compared to the 303 stainless steel. However, the use of certain metal alloys, such as a nickel alloy or a bronze alloy to manufacture at least the contact portion 116, 316 of the club head 100, 200 are capable of increasing the coefficient of friction ratio to about 1.2, which represents an increase in spin of about 2000 rpm over the 303 stainless steel and 1020 carbon steel. In an embodiment, the metal alloy is a 21-8 nickel alloy with a coefficient of friction of about 55.116. In an embodiment the metal alloy comprises bronze, copper, and at least one other metal such as 1018 soft carbon steel. In an embodiment, the metal alloy comprises at least about 20% bronze. In a further embodiment, the metal alloy comprises at least about 15% copper. Accordingly in this way, a golfer may drastically increase the spin imparted on the golf ball without increasing the ball speed.

Figure 10:
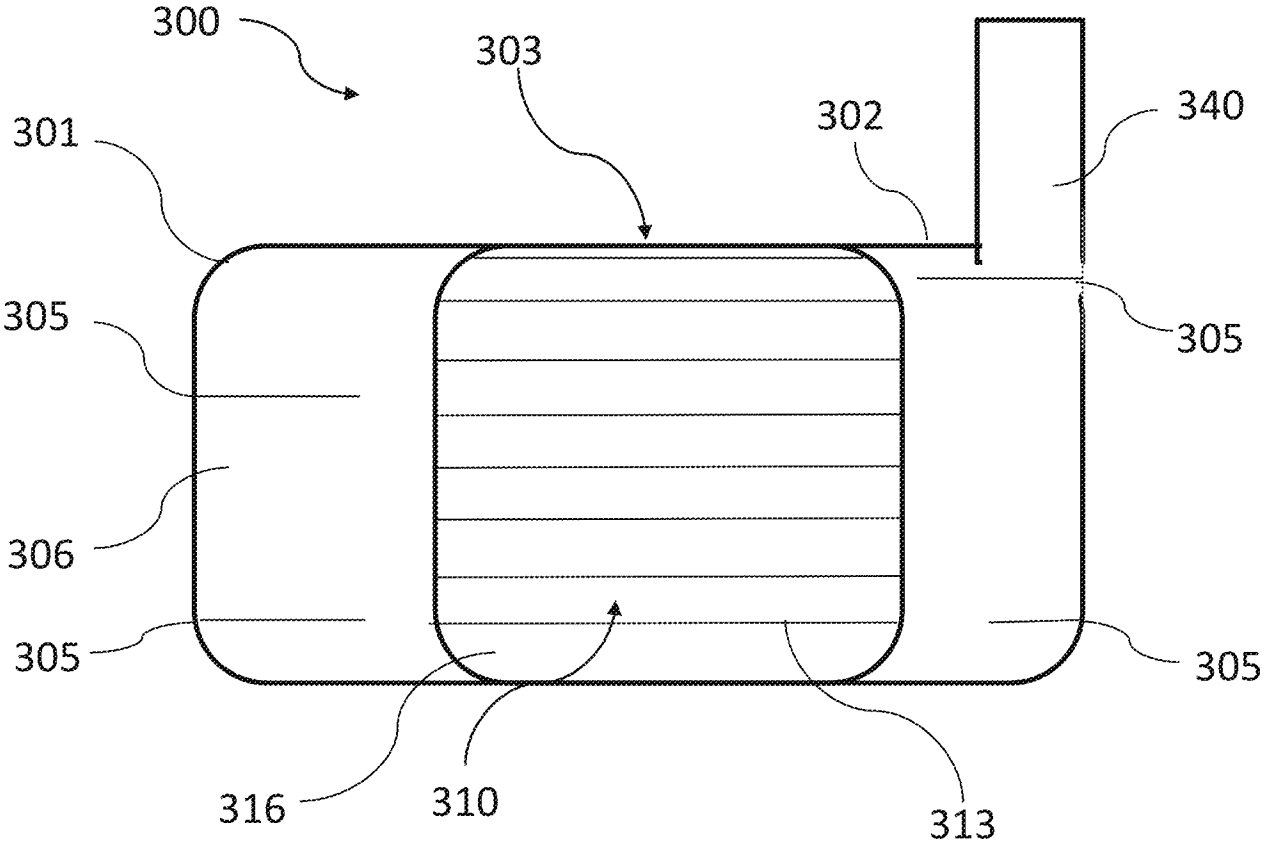
FIG. 10 illustrates a schematic depiction of a further embodiment of a forward face of the golf club head.
Figure 11:
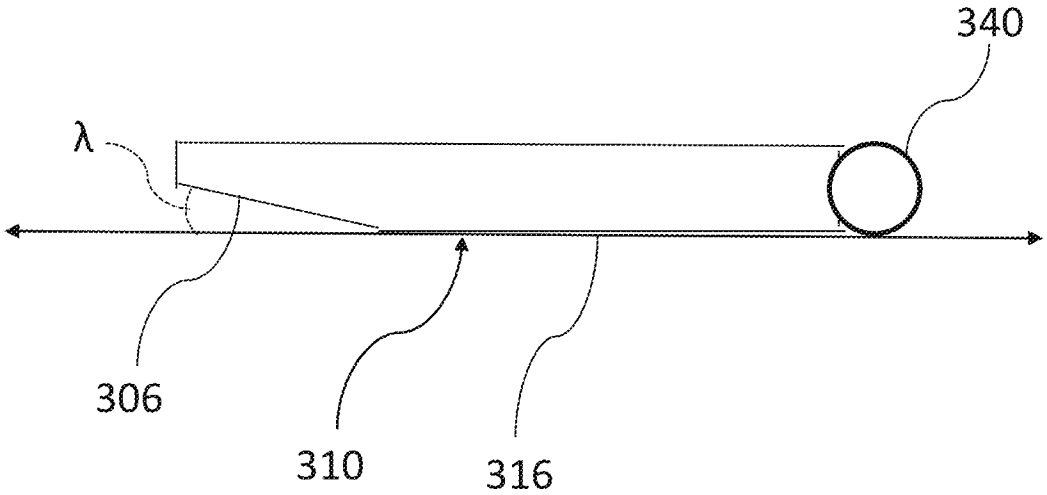
FIG. 11 illustrates a schematic depiction of a top view of the embodiment of the golf club head of FIG. 10.

It has further been discovered that improving air flow around the club head during the golf swing is another way to increase club head stability and club head speed and therefore, improve precision. Referring to FIG. 10, a schematic illustration of another embodiment of a club head 300 is shown comprising a forward face or forward facing surface 310 with a hitting surface 316 including a plurality of surface features, such as grooves 313, a heel end 302 connected to a hosel 340 and an opposing toe end 301. Four or more channels 305 extend generally towards the perimeter 50 (FIG. 1C) of the forward facing surface 310 of the body 303. As shown, these channels 305 are positioned approximately in the corners of the forward facing surface 310 and are configured to direct air flow around the forward face 310 of the body 303 during the down swing movement of the golf swing. In the example shown, the channels 305 are generally separate from the grooves 313, however in another embodiment the channels 305 may extend from one or more of the grooves 313. A top plan view of an embodiment of the club head 300 is schematically depicted in FIG. 11 showing the toe end surface 306 positioned at an angle λ relative to the hitting or contact portion 316. The angle λ is preferably about 10°, however in other embodiments α≤10°. The inventor has discovered that a 10° bevel is enough to improve aerodynamics while still preserving a forward face 310 that is still visually appealing or comfortable to the golfer's eye. In still other embodiments, one or more areas of the forward facing surface 310 that surround the contact portion 316 may slope relative to the contact portion in a direction towards the rearward surface and an angle of about 10°.

Figure 12:
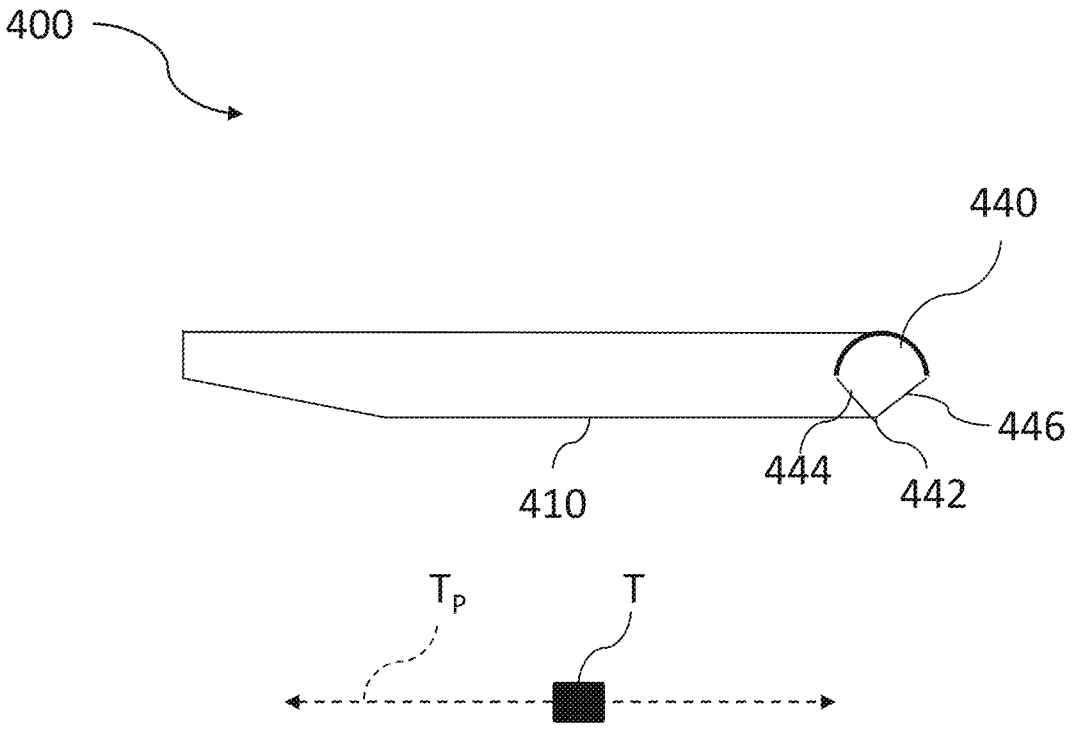
FIG. 12 illustrates a schematic depiction of a top view of another embodiment of the golf club head with another embodiment of the hosel.

As shown in FIG. 12, the shape of the hosel 440 may further be used to affect aerodynamics of the golf club head 400 and decrease drag during the downswing portion of the golf swing (FIG. 1B). As was previously discussed, decreasing the drag of the club head 400 during the down swing enables the player to increase the speed of the club head at the moment of impact with the golf ball 70 at point C (FIG. 1B). This in turn leads to the golf ball 70 traveling farther than if the club head speed were decreased at the moment of impact. The hosel 140, 340 of the club head 100, 200, 300 is generally cylindrical and comprises a circular cross-section. However, it is possible to further decrease drag during the down swing by changing the cross-section of the hosel. FIG. 12 illustrates a cross-section of an embodiment of a hosel 440 that comprises a vertex 442 that will generally point towards the target T or target plane $T_P$ when the club head 400 addresses the golf ball 70 at point A (FIG. 1B). The vertex 442 acts to direct air flow along adjacent sides 444, 446 and away from the hosel 440 during the down swing (FIG. 4B). Adjacent side 444 may further cooperate with one or more air channels 305 (FIG. 10) defined in the forward face 410 to direct air flow away from the hosel 440 and the club head 400 during the down swing movement (FIG. 1B).

While the present invention has been particularly shown and described with reference to certain exemplary embodiments, it will be understood by one skilled in the art that various changes in detail may be effected therein without departing from the spirit and scope of the invention that can be supported by the written description and drawings. Further, where exemplary embodiments are described with reference to a certain number of elements, it will be understood that the exemplary embodiments can be practiced utilizing either less than or more than the certain number of elements.

The invention claimed is:

1. A golf club head comprising:

a body extending from a first body end to a second body end and having a top and a bottom, the body comprising, a forward face extending between the top and the bottom of the body, the forward face comprising, a first forward facing surface portion defining plurality of grooves configured to contact a golf ball, a leading edge positioned proximate the bottom of the body, and a second forward facing surface portion adjacent the first forward facing surface portion, an opposing rearward facing surface extending between the top and the bottom of the body and defining a trailing edge proximate the bottom of the body, the rearward facing surface comprising at least one weight shifting element positioned proximate the second body end, and a sole extending between the leading edge and the trailing edge and defining a center portion, a first end surface and a second end surface; and a hosel connected to the body at the first body end and extending in a direction away from the sole, wherein, a static bounce angle is equal to an effective bounce angle when the center portion of the sole is square with a ground surface, and wherein the effective bounce angle is greater than the static bounce angle when the center portion is not square with the ground surface and the second end surface is positioned away from the ground surface.

2. The golf club head of claim 1, wherein at least one of the first end surface and the second end surface of the sole are positioned at an angle relative to the center portion of the sole.

3. The golf club head of claim 2, wherein the angle is about 10°.

4. The golf club head of claim 1, wherein the at least one weight shifting element comprises a depression.

5. The golf club head of claim 4, wherein the depression is configured to accept an insert comprising a material of lesser density than a material comprising the golf club head.

6. The golf club head of claim 1, wherein the first forward facing surface portion extends along a first forward facing surface plane and the second forward facing surface portion extends along a second forward facing surface plane, and wherein the first forward facing surface plane intersects the second forward facing surface plane.

7. The golf club head of claim 1, wherein at least the a first forward facing surface is comprised of a material having a coefficient of friction to urethane ratio that is greater than 1.

8. A method of manufacturing a golf club head configured to generate an increased rate of ball spin, the method comprising:

providing a golf club head comprising, a body extending from a first body end to a second body end and having a top and a bottom, the body comprising, a forward facing surface extending between the top and the bottom of the body, the forward facing surface comprising, a first forward facing surface portion defining plurality of grooves configured to contact a golf ball, a leading edge positioned proximate the bottom of the body, and a second forward facing surface portion adjacent the first forward facing surface portion, an opposing rearward facing surface extending between the top and the bottom of the body and defining a trailing edge proximate the bottom of the body, the rearward facing surface comprising at least one weight shifting element positioned proximate the second body end, and a sole extending between the leading edge and the trailing edge and defining a center portion, a first end surface and a second end surface; and a hosel connected to the body at the first body end and extending in a direction away from the sole; and forming the sole of the body such that (i) a static bounce angle is equal to an effective bounce angle when the center portion of the sole is square with ground surface, and (ii) the effective bounce angle is greater than the static bounce angle when the center portion is not square with the ground surface and the second end surface is positioned away from the ground surface.

9. The method of claim 8, wherein at least one of the first end surface and the second end surface of the sole are formed at an angle relative to the center portion of the sole.

10. The method of claim 9, wherein the angle is about 10°.

11. The method of claim 8, wherein the at least one weight shifting element comprises a depression.

12. The method of claim 11, wherein the depression is configured to accept an insert comprising a material of lesser density than a material comprising the golf club head.

13. The method of claim 8, wherein the first forward facing surface extends along a first forward facing surface plane and the second forward facing surface portion extends along a second forward facing surface plane, and wherein the first forward facing surface plane intersects the second forward facing surface plane.

14. The method of claim 8, wherein at least the a first forward facing surface is comprised of a material having a coefficient of friction to urethane ratio that is greater than 1.

* * * * *